US010767826B2

(12) United States Patent
Jiang et al.

(10) Patent No.: US 10,767,826 B2
(45) Date of Patent: Sep. 8, 2020

(54) INTELLIGENT ROAD LAMP

(71) Applicants: Shanghai Sansi Electronic Engineering Co. Ltd., Shanghai (CN); Shanghai Sansi Technology Co. Ltd., Shanghai (CN); Sansi Optoelectronics Technology (Shanghai) Co. Ltd., Shanghai (CN); Jiashan Sansi Optoelectronic Technology Co. Ltd., Jiashan, Zhejiang (CN)

(72) Inventors: Yuxi Jiang, Shanghai (CN); Li Xu, Shanghai (CN); Luping Liao, Shanghai (CN); Cui Yuan, Shanghai (CN)

(73) Assignees: SHANGHAI SANSI ELECTRONIC ENGINEERING CO. LTD., Minhang District, Shanghai (CN); SHANGHAI SANSI TECHNOLOGY CO. LTD., Nanhui New, Shanghai (CN); SANSI OPTOELECTRONICS TECHNOLOGY (SHANGHAI) CO. LTD., Nanhui New, Shanghai (CN); JIASHAN SANSI OPTOELECTRONIC TECHNOLOGY CO. LTD., Dayun Town, Jiashan, Zhejiang (CN)

( * ) Notice: Subject to any disclaimer, the term of this patent is extended or adjusted under 35 U.S.C. 154(b) by 0 days.

(21) Appl. No.: 16/081,313

(22) PCT Filed: Mar. 6, 2017

(86) PCT No.: PCT/CN2017/075728
§ 371 (c)(1),
(2) Date: Aug. 30, 2018

(87) PCT Pub. No.: WO2017/152816
PCT Pub. Date: Sep. 14, 2017

(65) Prior Publication Data

US 2019/0086047 A1 Mar. 21, 2019

(30) Foreign Application Priority Data

Mar. 7, 2016 (CN) ..... 2016 1 0128737
Mar. 7, 2016 (CN) ..... 2016 2 0172078 U

(51) Int. Cl.
*F21S 8/08* (2006.01)
*F21V 23/04* (2006.01)
(Continued)

(52) U.S. Cl.
CPC ..... *F21S 8/086* (2013.01); *F21S 2/005* (2013.01); *F21V 15/01* (2013.01); *F21V 23/009* (2013.01);
(Continued)

(58) Field of Classification Search
CPC .... F21S 8/086; F21V 23/0435; F21V 23/009; F21V 29/56; F21V 2/005; F21V 29/70
See application file for complete search history.

(56) References Cited

U.S. PATENT DOCUMENTS

2017/0227174 A1* 8/2017 May ..... F21V 7/00

FOREIGN PATENT DOCUMENTS

CN 103256525 A 8/2013
CN 203571542 U 4/2014
(Continued)

*Primary Examiner* — Joseph L Williams
(74) *Attorney, Agent, or Firm* — Global IP Services; Tianhua Gu

(57) ABSTRACT

An intelligent road lamp comprises a lamp base, which has a lamp base housing body provided with a mounting space inside, the mounting space has an open end facing downward, a plurality of access interfaces having spacing from each other is disposed in the mounting space, the access interfaces provide electrical and/or signal access; and at least one illumination module and at least one functional circuit module, disposed in the mounting space of the lamp base housing body, the illumination module and the functional
(Continued)

circuit module perform electrical and/or signal connection through the access interfaces. A functional circuit module is used as a module in a lamp base of a modularized road lamp product, thereby skillfully integrating the functional circuit module, and resolving a problem in the prior art that a road lamp product needs an additional space to mount a functional component.

6 Claims, 5 Drawing Sheets

(51) Int. Cl.

| | |
|---|---|
| ***F21V 23/00*** | (2015.01) |
| ***F21V 29/70*** | (2015.01) |
| ***F21V 29/56*** | (2015.01) |
| ***F21V 15/01*** | (2006.01) |
| ***F21V 23/06*** | (2006.01) |
| ***F21S 2/00*** | (2016.01) |
| *F21W 131/103* | (2006.01) |
| *F21Y 105/16* | (2016.01) |
| *F21V 29/76* | (2015.01) |
| *F21Y 115/10* | (2016.01) |

(52) U.S. Cl.

CPC ..... *F21V 23/0435* (2013.01); *F21V 23/06* (2013.01); *F21V 29/56* (2015.01); *F21V 29/70* (2015.01); *F21V 29/763* (2015.01); *F21W 2131/103* (2013.01); *F21Y 2105/16* (2016.08); *F21Y 2115/10* (2016.08)

(56) References Cited

FOREIGN PATENT DOCUMENTS

| | | | |
|---|---|---|---|
| CN | 104301377 | A | 1/2015 |
| CN | 204345491 | U | 5/2015 |
| CN | 204372699 | U | 6/2015 |
| CN | 204717540 | U | 10/2015 |
| CN | 204943247 | U | 1/2016 |
| CN | 205065522 | U | 3/2016 |
| CN | 105546426 | A | 5/2016 |
| CN | 205535324 | U | 8/2016 |
| KR | 20110019319 | A | 2/2011 |

* cited by examiner

INTELLIGENT ROAD LAMP

BACKGROUND OF THE PRESENT INVENTION

Field of Invention

The present patent application relates to the technical field of light fixture products, and in particular, to an intelligent road lamp.

Description of Related Arts

With the construction of a smart city, because of an advantage that road lamps are distributed in every corner of the city, the road lamps have become excellent carriers of implementation of various intelligent functions, it plays a huge role on network layout, monitoring, security and protection, positioning, and integration of various small functions facilitating life. However, the more functions are integrated, the more devices and control modules for implementing the functions, appearances and component structures of the road lamps greatly change, and unfavorable effects are generated on cost control, transportation, mounting and maintenance. For example, in the document record of Chinese Patent Application No. CN201530256482.2, some functional circuit components (such as a micro base station) and control components (such as a road lamp controller) for implementing functions in the technical solution of the patent are mounted in a box body which is integrated with a lamp pole at a bottom portion of the road lamp, the remaining functional circuit components are scatteredly mounted in various parts of the lamp pole. In this way, cable layout and transportation of a lamp pole body are both inconvenient, a difference from a conventional road lamp structure also means that a mold needs to be reopened, and cost is difficult to control. In addition, for another example, improvement is made based on this. For example, in the document record of Chinese Patent Application No. CN201521067834.0, a functional component and a control module are integrated by using an idea of modularization into a box body that may be disposed outside, which resolves problems such as transportation, maintenance and cable layout to some extent, but construction still needs to be performed on a road lamp pole body to mount the box body.

SUMMARY OF THE PRESENT INVENTION

In view of the above disadvantages of the prior art, an objective of the present patent application is to provide an intelligent road lamp, to integrate a functional component in a small size into a lamp base, and resolve the problems in the prior art.

To achieve the foregoing objective and other related objectives, the present patent application provides an intelligent road lamp, comprising a lamp base, wherein the lamp base comprises: a lamp base housing body, provided with a mounting space inside, wherein the mounting space has an open end facing downward; a plurality of access interfaces having spacing from each other disposed in the mounting space, wherein the access interfaces provide electrical and/or signal access; and at least one illumination module and at least one functional circuit module, disposed in the mounting space of the lamp base housing body, wherein the illumination module and the functional circuit module perform electrical and/or signal connection though the access interfaces.

In an embodiment of the present patent application, the functional circuit module comprises at least one of a pico base station module, a wireless antenna module, a camera, a sensor, or a radio frequency reading module.

In an embodiment of the present patent application, the functional circuit module is the pico base station module and/or the wireless antenna module, a side of the functional circuit module facing the open end is an antenna surface.

In an embodiment of the present patent application, the form of the access interfaces is one of an outlet or a socket, which is combined with the other one of an outlet or a socket disposed on the functional circuit module or the illumination module, to perform the electrical and/or signal connection.

In an embodiment of the present patent application, the functional circuit module is integrated in the at least one illumination module.

In an embodiment of the present patent application, a heat dissipation component is disposed on an outer surface of each said illumination module.

In an embodiment of the present patent application, the heat dissipation component is disposed on an outer surface of a top portion of the illumination module opposite to an illumination surface of the illumination module.

In an embodiment of the present patent application, the heat dissipation component is a heat dissipation fin or a heat conductive pipe provided with fluid therethrough.

In an embodiment of the present patent application, the mounting space comprises a first area used for disposing each said illumination module and a second area used for disposing the functional circuit module.

In an embodiment of the present patent application, the road lamp is a pixel-type lamp; each illumination module comprises a plurality of LED units disposed on a lower surface of the illumination module and protruding toward the open end; and a plurality of heat dissipation components disposed around the outside of the LED units in one-to-one correspondence are disposed on the lower surface of the illumination module.

In an embodiment of the present patent application, a hollow used for heat dissipation is disposed on the top portion of the lamp base housing body.

In an embodiment of the present patent application, a plurality of the illumination modules and the functional circuit module are arranged along a length direction of the lamp base.

As described above, the present patent application provides an intelligent road lamp, comprising a lamp base, wherein the lamp base comprises: a lamp base housing body, provided with a mounting space inside, wherein the mounting space has an open end facing downward, a plurality of access interfaces having spacing from each other disposed in the mounting space, wherein the access interfaces provide electrical and/or signal access; and at least one illumination module and at least one functional circuit module, disposed in the mounting space of the lamp base housing body, wherein the illumination module and the functional circuit module perform electrical and/or signal connection through the access interfaces. A functional circuit module is used as a module in a lamp base of a modularized road lamp product, thereby skillfully integrating the functional circuit module, and resolving a problem in the prior art that a road lamp product needs an additional space to mount a functional component.

DESCRIPTIONS OF REFERENCE NUMERALS

1 Lamp base housing body;
11 Access interface;
2 Illumination module;
21 LED unit;
22 Heat dissipation component;
2*a* Illumination module integrating a functional circuit module;
3 Lamp base housing body;
31 Access interface;
4 Illumination module;
41 LED unit;
42 Heat dissipation component;
5 Functional circuit module;
6 Lamp base housing body; and
61 Hollow.

DETAILED DESCRIPTION OF THE PREFERRED EMBODIMENTS

Implementation modes of the present patent application are described below by using specific embodiments. Those skilled in the art can easily understand other advantages and effects of the present patent application according to the content disclosed in the specification.

Please refer to FIG. 1 to FIG. 7, it should be noted that the structure, the proportion, the size, and the like shown in the accompanying drawings of the specification are all used to cooperate with the content disclosed in the specification, are provided for those skilled in the art to learn and read, and are not used to limit a limiting condition under which the present patent application can be implemented. Therefore, they do not have substantive meanings in the technology. Any modifications of the structure, changes of proportional relationships, or adjustments of the size shall fall within the scope that can be covered by the technical content disclosed by the present patent application, without affecting the effects produced by the present patent application and the objectives achieved by the present patent application. Moreover, terms such as "above", "below", "left", "right", "middle" and "one" used in the specification are also only to facilitate clear descriptions, and are not used to limit the scope where the present patent application can be implemented. Changes or adjustments of the relative relationship thereof should also be considered as the scope where the present patent application can be implemented, without substantially changing the technical content.

The technical solution of the present patent application is applied to an intelligent road lamp product. A functional circuit module refers to a module structure that can implement functions such as sensing, communication, control and network transmission in addition to an illumination function. Certainly, the road lamp preferably uses a relatively environmentally friendly LED light source, but is not limited thereto.

Figure 1:
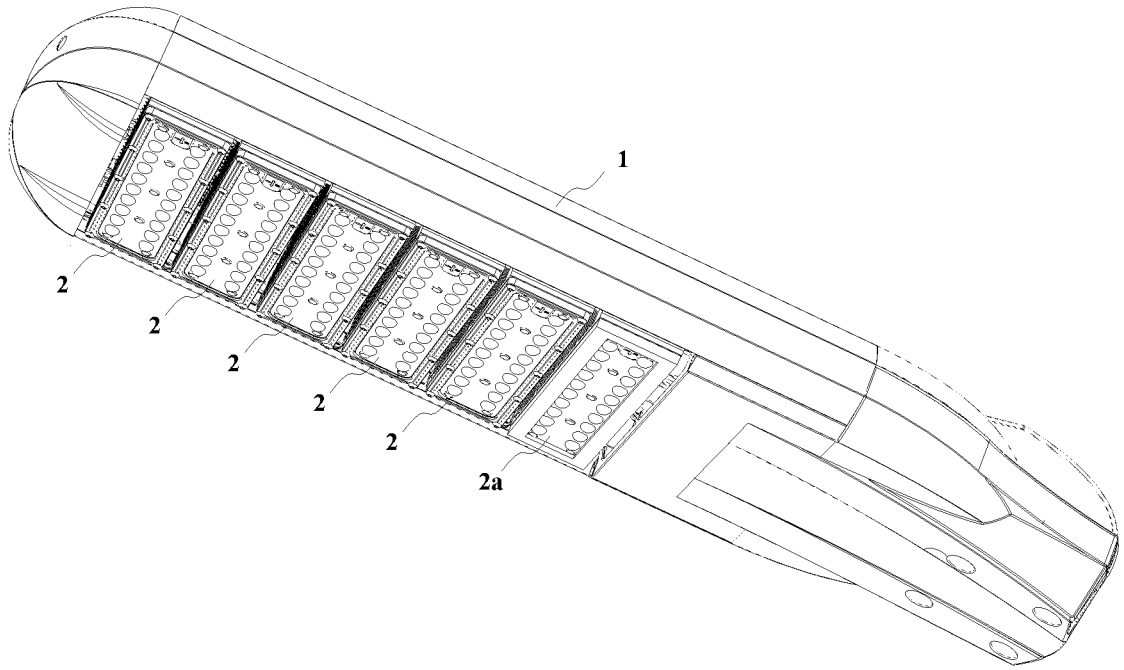
FIG. 1 is a schematic diagram of a composite structure of a lamp base part of an intelligent road lamp according to a first embodiment of the present patent application.
Figure 2:
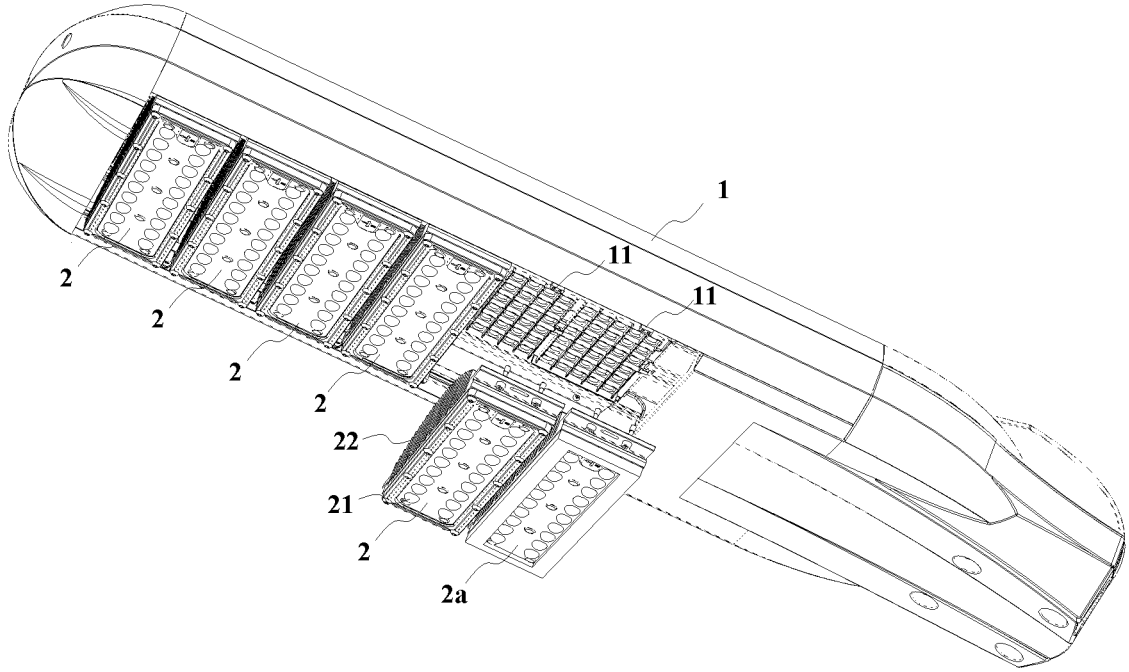
FIG. 2 is a schematic diagram of an exploded structure of the lamp base part of the intelligent road lamp according to the first embodiment of the present patent application.
Figure 3:
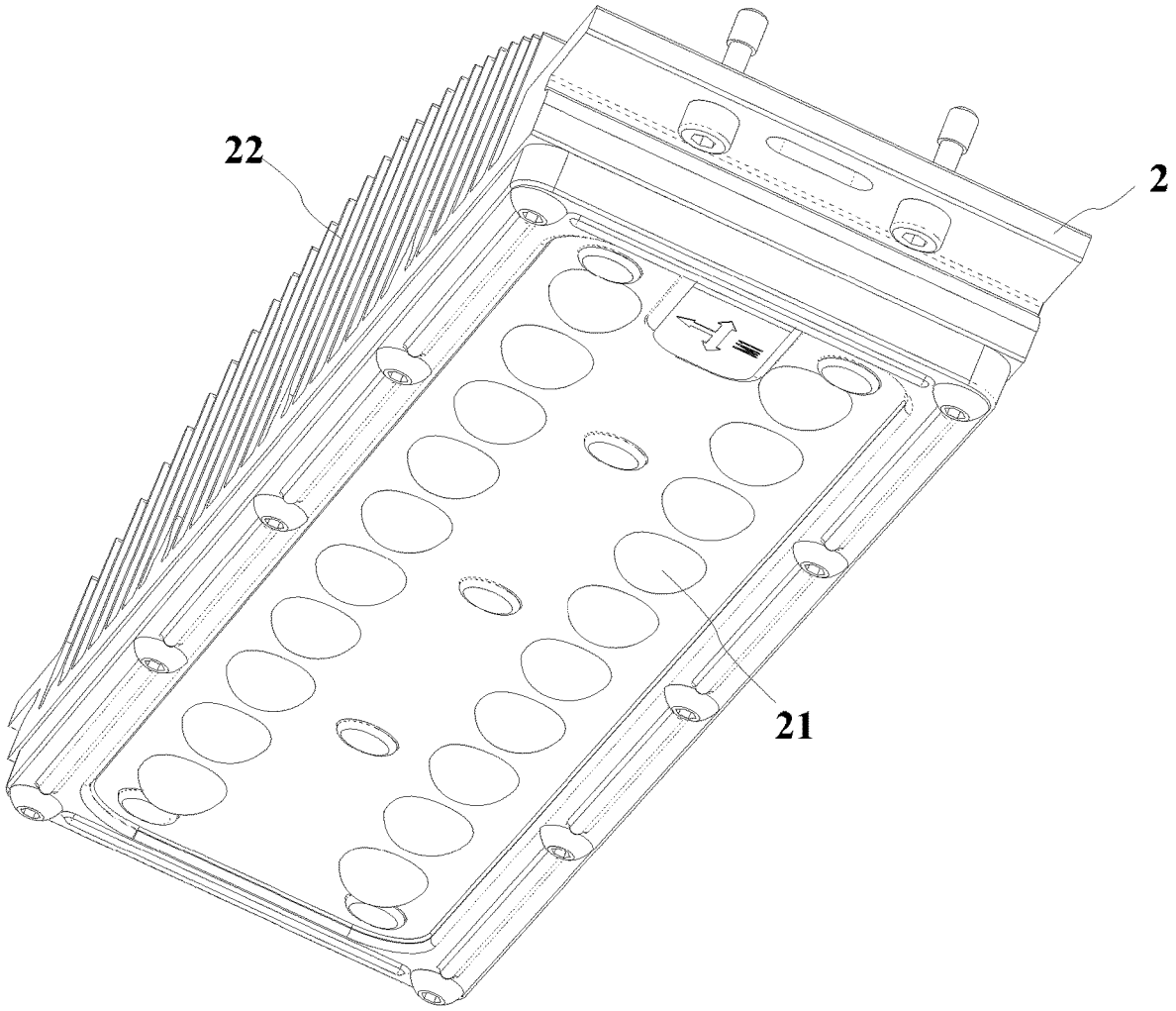
FIG. 3 is a schematic diagram of an enlarged structure of an illumination module according to the first embodiment of the present patent application.

Please refer to FIG. 1 and FIG. 2, which show a composite structure and an exploded structure of a lamp base part of an intelligent road lamp according to a first embodiment of the present patent application. In the present embodiment, an aluminium profile lamp is used as a representative for description. A feature of this type of light fixture is that light sources in an illumination module thereof share a heat dissipation component. Generally, these heat dissipation components are made of a material having a high heat conductive coefficient, for example, aluminum or aluminum alloys. Certainly, in other embodiments, other heat conductive metal or other composite materials, for example, ceram, may alternatively be used. Preferably, in the present embodiment, refer to FIG. 2 and FIG. 3, it can be learned that a plurality of LED units 21 (which may comprise LEDs, light distribution lenses, or the like) are integrated on each of the illumination modules (2, 2*a*), a surface of the illumination module facing downward is an illumination surface, and a heat dissipation component is disposed on an upper surface of a top portion of the illumination module opposite to the illumination surface. In the present embodiment, the heat dissipation component 22 is a heat dissipation fin. Certainly, in other embodiments, the heat dissipation component may alternatively be other implementation modes, for example, a heat conductive pipe. The heat conductive pipe may be provided with fluid, for example, air or heat conductive liquid, therethrough to implement heat conduction. Because there are many implementations, the implementations are not listed one by one herein. Specifically, the lamp base comprises a lamp base housing body 1, the lamp base housing body 1 has a mounting space inside, the mounting space has an open end facing downward, a plurality of access interfaces 11 having spacing from each other is disposed in the mounting space, the access interfaces 11 provide electrical and/or signal access and are used for placing illumination modules and a functional circuit module, wherein the illumination modules and the functional circuit module perform electrical and/or signal connection through the access interfaces. It should be noted that the access interfaces are components providing an electrical and/or signal access function between the illumination modules or the functional circuit module and the lamp base, for example, the access interfaces may be plugs, sockets, or electrical or signal contact in other forms. In a preferred embodiment, electrical and/or signal connection between the illumination modules or the functional circuit module and the access interfaces uses paired plugs and sockets that can be separated from each other, to facilitate maintenance and upgrade of each separate module. Circuits and/or communication lines disposed in the lamp base and correspondingly connected to the access interfaces are connected to external lines through a hole at a portion at which a lamp base housing body is connected to a road lamp pole. In this way, complexity of cable layout of a conventional road lamp integrating various functions is avoided, and mounting is more convenient.

The functional circuit module comprises at least one of a pico base station module, a wireless antenna module (such as WiFi, Bluetooth, an infrared module and the like), a camera, a sensor, or a radio frequency reading module. In the present embodiment, the functional circuit module is integrated in an illumination module 2*a*. That is, the module 2*a* implements not only illumination but also an additional integration function. For such a module, it should be considered that the module is not only an illumination module but also a functional circuit module. Certainly, a functional circuit module may also not implement an illumination function, but serve as only a functional circuit module. In the present embodiment, a pico base station is used as an example for description. Those skilled in the art may understand that this may also be similarly applied to integration of a device such as a wireless antenna, a micro-camera and a sensor. Because the type of the illumination module of the present embodiment is that the light sources share a heat dissipation component, a relatively large empty space may be used for adjusting disposing of the light sources. For example, the light sources are disposed more compact, thereby arranging antennas and lines of the pico base station at an empty area around an illumination area; alternatively, the quantity of disposed light sources is decreased, thereby arranging the antennas and the lines of the pico base station at an empty area, or even an empty space on an original illumination module is sufficient to support to arrange the antennas and the lines of the pico base station at the empty area around the illumination area. In this way, the manner of implementing not only illumination but also the additional integration function can implement the basis of the additional function when affecting an illumination effect to the smallest extent.

It should be described that a full name of the pico base station is a pico cell base station, which is used for constructing a mobile communication 2G/3G/4G/5G network. With further increase of a capacity requirement of users, a pico cell is substantially one type of micro cell, but a coverage radius of the pico cell is smaller, which is generally only 10 m to 30 m; and a transmit power of the pico cell base station is smaller, which is approximately tens of milliwatts. These outdoor pico cell base stations may be inserted on utility poles, lamp poles and roofs, to deal with a great requirement of an emerging smartphone market. By using the solution of the present patent application, the pico base station can be perfectly integrated into a road lamp base, and a volume occupied by the pico base station can be smaller by using a heat dissipation system of the lamp base.

In an embodiment, the illumination modules (2 and 2*a*) may be fastened to the lamp base housing body 1 by means of, for example, screwing or clamping. For example, threaded holes are provided on a wall surface of the mounting space in the lamp base housing body 1, and screws screwed into the threaded holes are disposed on the illumination modules (2 and 2*a*); alternatively, the lamp base housing body 1 and the illumination modules (2 and 2*a*) are fastened to each other by using components respectively disposed in a concave-convex fit.

As shown in the figure, the mounting space may be a rectangular body, the width and the thickness of the mounting space are consistent with the length and the thickness of each of the illumination modules (2 and 2*a*), the illumination modules (2 and 2*a*) are arranged in the mounting space in a manner of connecting long sides to each other, and the length of the mounting space is equal to the sum of widths of the illumination modules (2 and 2*a*); the length and the width of the mounting space correspond to those of the lamp base, therefore the illumination modules (2 and 2*a*) are arranged in a length direction of the lamp base. It may be understood that shapes of the mounting space and the illumination modules (2 and 2*a*) may be designed to other geometries suitable for mounting, for example, a regular polygon, an irregular shape having combining sides in a concave-convex fit to each other, and the like. This is not specifically defined herein. For a corresponding design manner, corresponding access interfaces need to be disposed in the mounting space of the lamp body.

Figure 4:
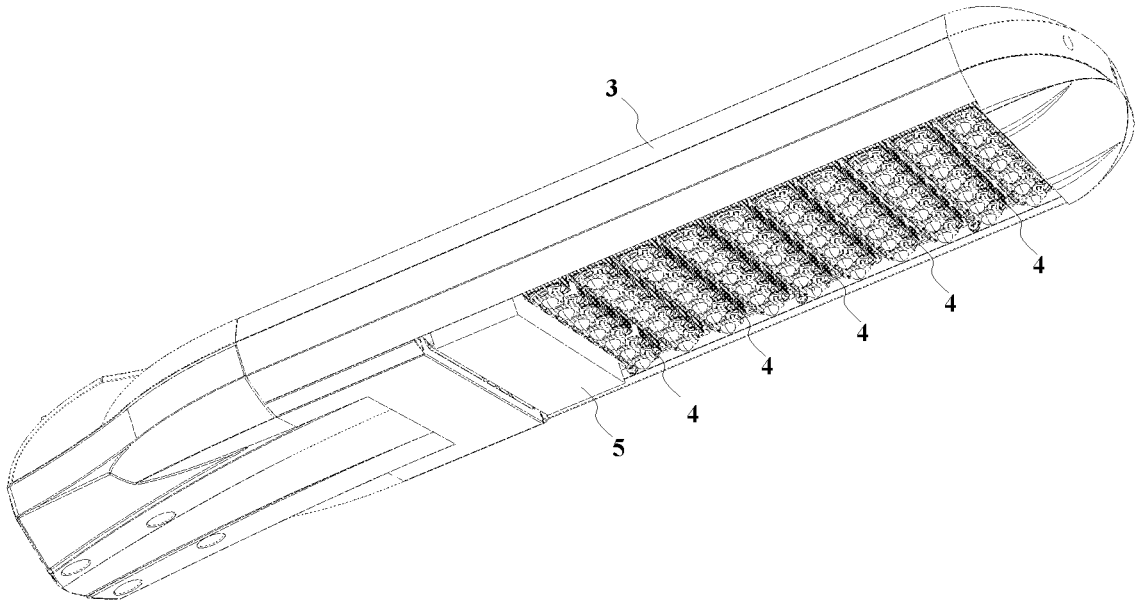
FIG. 4 is a schematic diagram of a composite structure of a lamp base part of an intelligent road lamp according to a second embodiment of the present patent application.
Figure 5:
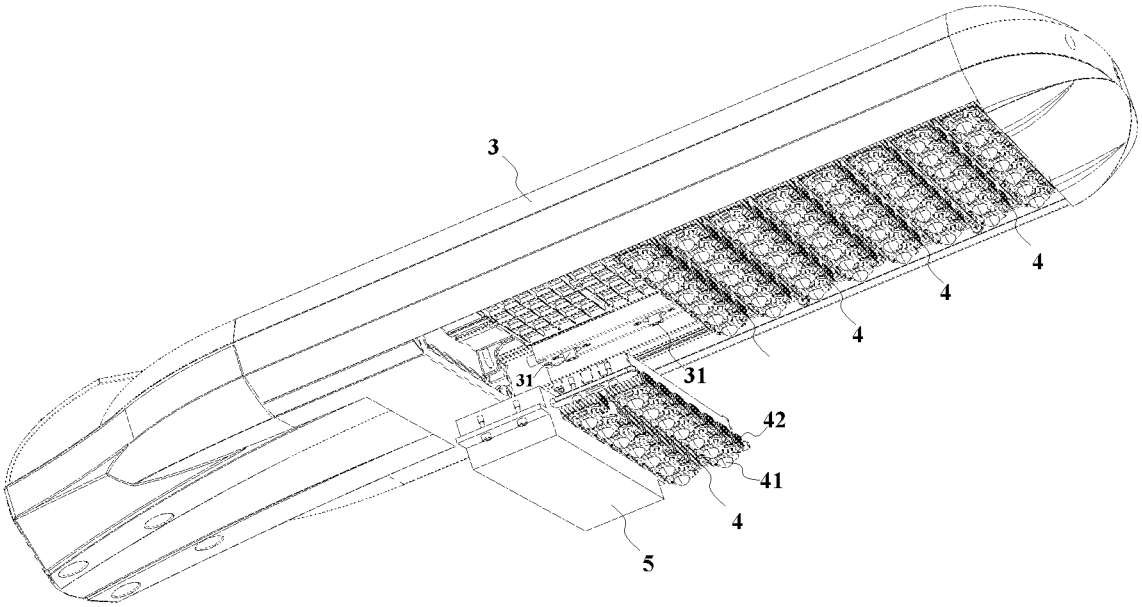
FIG. 5 is a schematic diagram of an exploded structure of the lamp base part of the intelligent road lamp according to the second embodiment of the present patent application.
Figure 6:
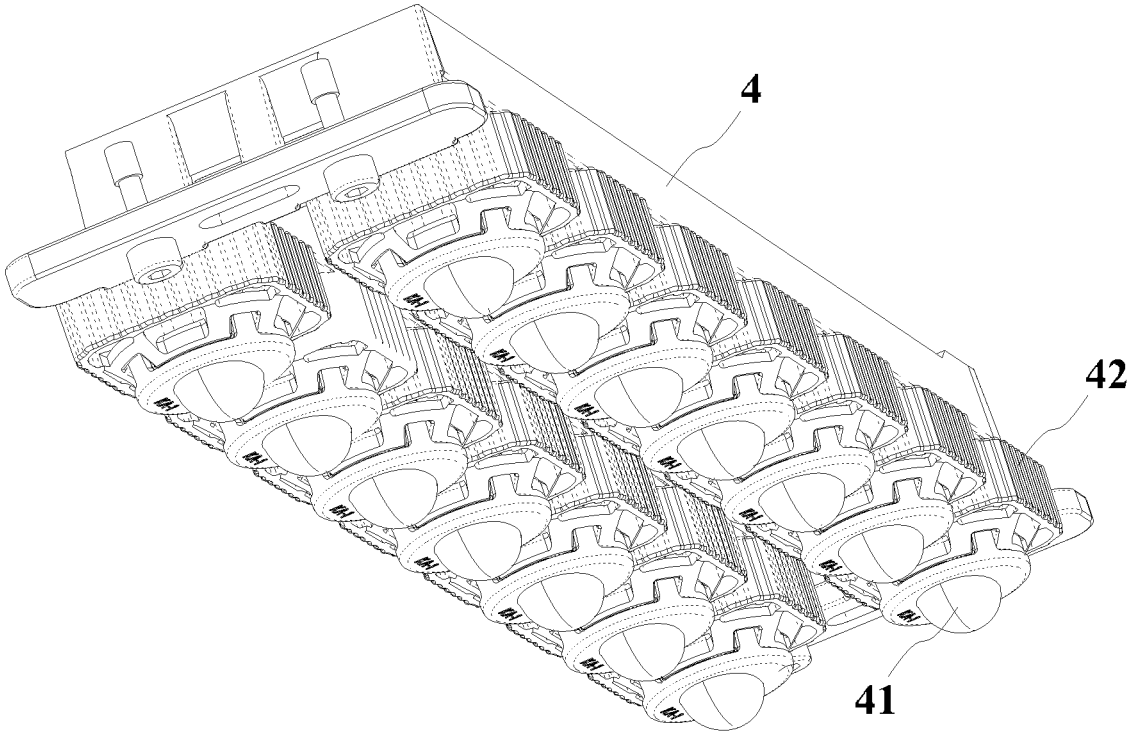
FIG. 6 is a schematic diagram of an enlarged structure of an illumination module according to the second embodiment of the present patent application.

As shown in FIG. 4 and FIG. 5, the present patent application further provides a second embodiment. A main difference from the foregoing embodiment lies in that in the present embodiment, the road lamp uses a pixel-type lamp as a representative for description, and a feature of this type of light fixture lies in using a cell heat dissipation technology, that is, each light source has a separate heat dissipation body. In the present embodiment, a surface of each illumination module 4 facing downward is an illumination surface, and a plurality of LED units 41 are convexly disposed on the surface. As shown in FIG. 6, each LED unit 41 may comprise an LED and a lens covering outside. In addition, as shown in the figure, a plurality of heat dissipation components 42 are further disposed on the lower surface of the illumination module 4 and are disposed around the outside of each of the LED units 41 in one-to-one correspondence. The heat dissipation components 42 may enclose a heat dissipation fin of an annular structure. In other embodiments, the heat dissipation components 42 may alternatively be set to hollow heat dissipation through holes. The annular structure is, for example, a round annular shape, a square annular shape, or an annular shape in another shape. Therefore, to make the lamp base housing bodies (1, 3) in the first embodiment and the second embodiment in common use, the sizes of the lengths, the widths, and the heights of illumination modules (2, 2*a* and 4) in the two embodiments are preferably the same. Because each light source has a separate heat dissipation body, when the LED units 41 of the illumination module 4 in the second embodiment occupy a relatively large space, there is no sufficient continuous space for disposing a functional circuit module 5. Therefore, the functional circuit module 5 needs to get away from the pixel illumination module to be separately disposed, for example, the functional circuit module 5 may be set to be a same size as that of the first embodiment. That is, a mounting space of a lamp base housing body 3 needs to comprise a first area used for disposing the illumination modules 4 and a second area used for disposing the functional circuit module 5. In the present embodiment, a size of the functional circuit module 5 is totally the same as that of the illumination module 4, and the functional circuit module 5 replaces an illumination module. The functional circuit module 5 may be, for example, disposed at a downmost position of the mounting space in the figure and arranged with the illumination modules 4. Compared with the first embodiment, an advantage of the present embodiment lies in that the illumination modules use the forms of pixel lamps and have a larger free combination manner compared with a lamp in which entire modules share a heat dissipation body. That is, each illumination module may be provided with any quantity of pixel units to form any shape, and the combination is more flexible. For example, the illumination module may be set to be a rectangular-ambulatory-plane, and a functional circuit module is disposed in the center of the rectangular-ambulatory-plane.

It should be noted that, as shown in FIG. 5, a plurality of access interfaces 31 having spacing from each other are disposed in the mounting space, and may provide electrical and/or signal access.

In the first embodiment and second embodiment described above, when the functional circuit module is selected as the pico base station module and/or the wireless antenna module, a side of the functional circuit module facing the open end of the lamp base housing body is an antenna surface.

Figure 7:
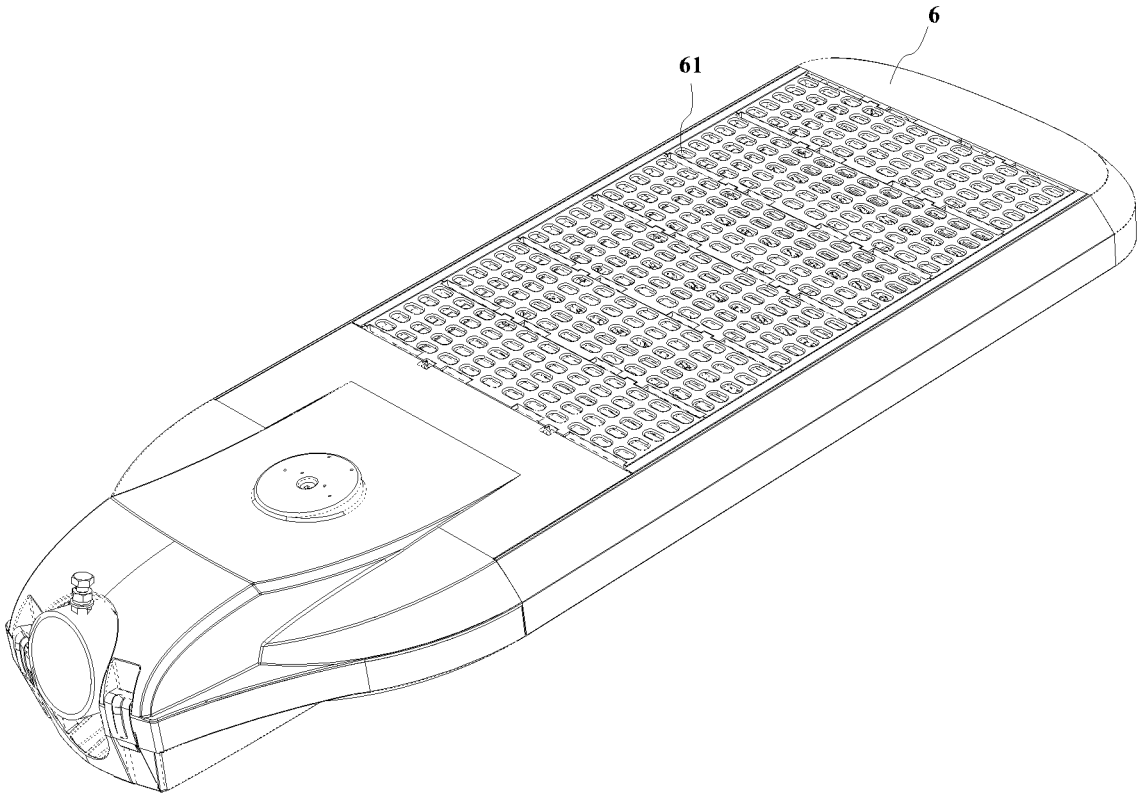
FIG. 7 is a schematic structural diagram of a top surface of the lamp base part of the intelligent road lamp according to an embodiment of the present patent application.

As shown in FIG. 7, preferably, a hollow 61 may be disposed on a top portion of a lamp base housing body 6. Preferably, a plurality of the hollows 61 may be disposed and be arranged in the form of an array. The solution may be applied to the first embodiment or the second embodiment. In the first embodiment, the hollow corresponds to heat dissipation components at a back surface of the illumination modules (2 and 2*a*) and directly dissipates heat. In addition, in the second embodiment, the hollow also implements a convective heat dissipation structure of the lamp base housing body 3 that is transparent from top to bottom, and can also perfectly resolve a heat dissipation problem of the functional circuit module 5 integrated into the pixel-type road lamp base. It should be understood that the present application does not enumerate detailed implementation modes of cell heat dissipation (a pixel lamp), reference may be made to previous applications related to the technology and applications of an improved solution of the applicant, for example, Chinese Patent Applications No. 200810204172.5, No. 20072007657.8, and No. 20121048403.0, and applications which are not listed in detail one by one herein.

In conclusion, the present patent application provides an intelligent road lamp, comprising a lamp base, wherein the lamp base comprises: a lamp base housing body, provided with a mounting space inside, wherein the mounting space has an open end facing downward, a plurality of access interfaces having spacing from each other disposed in the mounting space, wherein the access interfaces provide electrical and/or signal access; and at least one illumination module and at least one functional circuit module, disposed in the mounting space of the lamp base housing body, wherein the illumination module and the functional circuit module perform electrical and/or signal connection though the access interfaces. A functional circuit module is used as a module in a lamp base of a modularized road lamp product, thereby skillfully integrating the functional circuit module, and resolving a problem in the prior art that a road lamp product needs an additional space to mount a functional component.

Therefore, the present patent application effectively overcomes various disadvantages in the prior art, and has a high industrial utilization value.

The foregoing embodiments merely exemplarily describe the principles and effects of the present patent application, but are not intended to limit the present patent application. Any person skilled in the art may modify or change the foregoing embodiments without departing from the spirit and scope of the present patent application. Therefore, any equivalent modification or change made by any person of ordinary skill in the technical field without departing from the spirit and technical ideas disclosed in the present patent application shall fall within the claims of this patent application.

What is claimed is:

1. An intelligent road lamp comprising:

a lamp base which comprises:

a lamp base housing body, provided with a mounting space inside, the mounting space has an open end facing downward; a plurality of access interfaces having spacing from each other disposed in the mounting space, the access interfaces provide electrical and/or signal access;

at least one illumination module and at least one functional circuit module, disposed in the mounting space of the lamp base housing body, the illumination module and the functional circuit module perform electrical and/or signal connection through the access interfaces;

the functional circuit module is integrated in the at least one illumination module, a plurality of the illumination modules and the functional circuit module are arranged along a length direction of the lamp base on a bottom side of the lamp base; and the road lamp is a pixel-type lamp, each illumination module comprises a plurality of LED units disposed on a lower surface of the illumination module and protruding toward the open end, and a plurality of heat dissipation components disposed around the outside of the LED units in one-to-one correspondence are disposed on the lower surface of the illumination module.

2. The intelligent road lamp as in claim 1, wherein the functional circuit module comprises at least one of a pico base station module, a wireless antenna module, a camera, a sensor, or a radio frequency reading module.

3. The intelligent road lamp as in claim 2, wherein the functional circuit module is the pico base station module and/or the wireless antenna module, a side of the functional circuit module facing the open end is an antenna surface.

4. The intelligent road lamp as in claim 1, wherein the form of the access interfaces is one of an outlet or a socket, which is combined with the other one of an outlet or a socket disposed on the functional circuit module or the illumination module to perform the electrical and/or signal connection.

5. The intelligent road lamp as in claim 1, wherein the heat dissipation component is a heat dissipation fin or a heat conductive pipe provided with fluid therethrough.

6. The intelligent road lamp as in claim 1, wherein a hollow used for heat dissipation is disposed on the top portion of the lamp base housing body.

* * * * *